US005138332A

United States Patent [19]

Carlotta

[11] Patent Number: 5,138,332

[45] Date of Patent: Aug. 11, 1992

[54] INK JET PRINTING APPARATUS

[75] Inventor: Michael Carlotta, Sodus, N.Y.

[73] Assignee: Xerox Corporation, Stamford, Conn.

[21] Appl. No.: 604,303

[22] Filed: Oct. 29, 1990

[51] Int. Cl.[5] ..... B41J 2/175

[52] U.S. Cl. ..... 346/1.1; 346/140 R

[58] Field of Search ..... 346/140 R, 1.1

[56] References Cited

U.S. PATENT DOCUMENTS

| | | | |
|---|---|---|---|
| 4,123,761 | 10/1978 | Kimura | 346/140 R |
| 4,333,087 | 6/1982 | Yamaguti | 346/140 R |
| 4,518,974 | 5/1985 | Isayama | 346/140 |
| 4,567,494 | 1/1986 | Taylor | 346/140 |
| 4,571,599 | 2/1986 | Rezanka | 346/140 |
| 4,575,738 | 3/1986 | Sheufelt et al. | 346/140 |
| 4,591,873 | 5/1986 | McCann et al. | 346/75 |
| 4,620,202 | 10/1986 | Koto | 346/140 |
| 4,679,059 | 7/1987 | Dagna | 346/140 |
| 4,689,641 | 8/1987 | Scardovi | 346/140 R |
| 4,734,719 | 3/1988 | Suzuki | 346/140 |
| 4,831,389 | 5/1989 | Chan | 346/140 |
| 4,837,585 | 6/1989 | Williams et al. | 346/75 |
| 4,853,717 | 8/1989 | Harmon et al. | 346/140 |

FOREIGN PATENT DOCUMENTS 257857 11/1987 Japan .

*Primary Examiner*—Joseph W. Hartary
*Attorney, Agent, or Firm*—Robert A. Chittum

[57] ABSTRACT

In an ink jet printer, a printhead assembly comprising a printhead and an ink reservoir is mounted on a scanning carriage for movement across a recording medium. During printing, droplets of ink are expelled from ink channels within the printhead and the channels are replenished with ink which is drawn in from the reservoir. The reservoir is connected to an ink source from which ink is supplied during printing and when the printhead assembly is being primed. A partition within the reservoir ensures that, during priming, air can be expelled from the reservoir through the ink channels, thereby avoiding the need for an air vent from the reservoir.

16 Claims, 3 Drawing Sheets

INK JET PRINTING APPARATUS

BACKGROUND OF THE INVENTION

The present invention relates to ink jet printing apparatus and is concerned, more particularly, with the priming of the printhead(s) in such apparatus.

An ink jet printer may be of the "continuous stream" or the "drop-on-demand" type. In the continuous stream type of printer, ink is emitted continuously from one or more orifices in a printhead, producing droplets which are deflected as necessary so that they are deposited either in a specific location on a recording member or, if not required for printing, in a gutter from where they are recirculated. In the drop-on-demand type of printer, ink is contained in a plurality of channels in a printhead and energy pulses are used to cause the droplets of ink to be expelled, as required, from orifices at the ends of the channels and directed towards a recording member.

In a thermal ink jet printer, those energy pulses are usually produced by resistors, each located in a respective one of the channels, which are individually addressable by current pulses to heat and vaporize ink in the channels. As a vapour bubble grows in any one of the channels, ink bulges from the channel orifice until the current pulse has ceased and the bubble begins to collapse. At that stage, the ink within the channel retracts and separates from the bulging ink which forms a droplet moving in a direction away from the channel and towards the recording medium. The channel is then re-filled by capillary action, which in turn draws ink from a supply container.

It is usually necessary to prime a printhead of an ink jet printer before use, to remove air and ensure that the printhead is full of ink. Priming may, for example, be carried out by applying suction to the ink ejecting orifice(s) to draw ink into the printhead. Alternatively, ink can be forced into the printhead under pressure.

U.S. Pat. No. 4,734,719 describes an ink jet printer in which a capping device is provided to apply suction to the printhead orifices to recover the discharge function of the printhead after a period of non-use. In that printer, the ink channels within the printhead communicate with, and receive ink from, a sub-tank which in turn is supplied with ink from a remote main tank. Air collects in the sub-tank and is removed by applying suction to the sub-tank before suction is applied to the printhead orifices. Suction is applied to the sub-tank via a plurality of suction tubes provided specifically for that purpose. Another printer in which the printhead is primed by applying suction to the printhead orifices is described in U.S. Pat. No. 4,853,717. In that printer, the printhead is part of a cartridge which also contains a reservoir of ink.

U.S. Pat. No. 4,575,738 describes an ink jet printer in which pressurized air is used to deliver ink from a remote supply to the printhead via an ink chamber which forms part of the printhead module. Any entrained air in the ink is separated out and trapped in the ink chamber. To remove the trapped air, a purging vent in the chamber is opened and the air is then forced out through the vent by delivering ink to the chamber. Another arrangement for removing air from the ink chamber of a printhead while printing is in progress is described in U.S. Pat. No. 4,679,059.

U.S. Pat. No. 4,591,873 to McCann et al discloses an ink jet printing apparatus with an orifice cleaning system including cooperative elements which apply varying pressure differentials across an orifice plate to oscillate ink into and out of the orifices. The pressure differentials may be implemented by varying ink impedance cross-flow through a printhead.

U.S. Pat. No. 4,837,585 to Williams et al discloses an ink jet printer having an improved system for reducing pressure variations. A damping system reduces ink pressure transients within a printhead means and includes a damping chamber for a gas-over-ink region coupled to an ink return conduit and a printer subsystem for periodically introducing gas into the ink return conduit.

U.S. Pat. No. 4,518,974 to Isayama discloses an ink jet air removal system which detects the presence of air bubbles in ink and removes these bubbles by pulling an ink-air boundary into an ink chamber thereby transferring the air bubbles to the air.

The present invention relates to ink jet printers of the type in which the printhead has an associated ink reservoir through which ink is supplied to the printhead from a remote supply tank and in which air collects, for example by separating out from the ink before the ink enters the printhead. Conventionally, in a printer of that type, the reservoir is provided with a vent through which air can be removed, particularly when the printhead assembly is being primed. In some printers the vent is connected via a return line to the remote supply tank.

SUMMARY OF THE INVENTION

It is an object of the invention to facilitate the priming of the printhead and the associated reservoir, and to simplify the printhead assembly, by enabling air to be removed from the reservoir without the need for a vent.

According to the present invention, a printhead assembly for an ink jet printer comprises an ink reservoir and a printhead, wherein the printhead has at least one ink channel that communicates with the reservoir, an ink ejecting orifice at one end of the channel and means operable to cause droplets of ink to be expelled from the orifice for depositing on a recording medium, and wherein the reservoir has an ink inlet through which the assembly receives ink. Partition means is located within the reservoir whereby, when the assembly is being primed, air vents from within the reservoir through the printhead orifice(s).

In embodiments of the invention described herein, the partition means defines, within the reservoir, a chamber on one side of the partition that communicates with the said inlet and a chamber on the other side of the partition that communicates with the ink channel(s). In one embodiment, the partition means has at least one opening therethrough in a lower part of the reservoir, and at least one opening therethrough in an upper part of the reservoir. The total resistance to ink flow presented by the opening(s) in the upper part of the reservoir is less than the total resistance to ink flow presented by the opening(s) in the lower part of the reservoir. In another embodiment, the partition means comprises a screen mesh.

The printhead assembly can be primed by applying suction to the printhead orifice(s) to draw ink into the reservoir through the said inlet or by supplying ink under pressure to the said ink inlet of the reservoir.

In a printer incorporating the printhead assembly of the invention, the printhead assembly may be mounted on a scanning carriage for movement backwards and forwards across the recording medium, an ink source being provided to supply ink to the reservoir.

By way of example, embodiments of the invention will be described with reference to the accompanying drawings, wherein like parts have the same index numerals.

DESCRIPTION OF THE PREFERRED EMBODIMENTS

Figure 1:
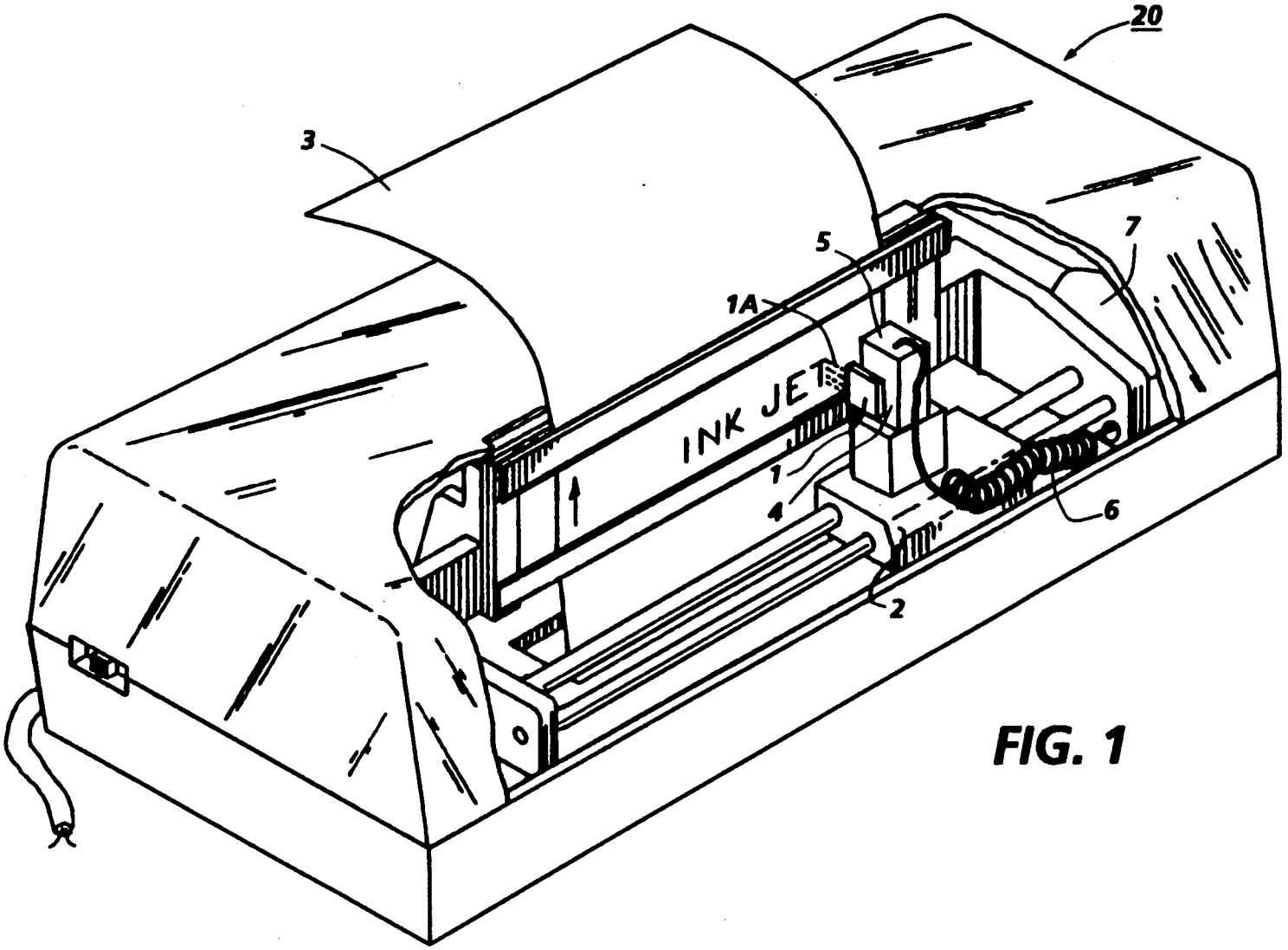
FIG. 1 is a general view of a thermal ink jet printer.

In FIG. 1 of the drawings, the printhead of the thermal ink jet printer 20 is indicated at 1. The printhead 1 is conventional and contains a plurality of ink channels (not visible) each of which has an ink ejecting orifice (also not visible) at one end. The printhead is mounted on a reciprocable carriage 2 which, during a printing operation, carries the printhead backwards and forwards across a recording medium 3. As the printhead is being moved, the resistors within the printhead channels are energised selectively to cause droplets of ink 1A to be directed at the recording medium 3, as already described, to produce the required printed information. Mounted adjacent the printhead 1 on one side is an ink reservoir 4 from which ink is drawn into the printhead channels to replace that expelled during printing. A heat sink 8 (see FIG. 2) mounted on the other side of the printhead has been omitted in this figure for clarity. The reservoir 4 is connected via a supply line 6 to a remote ink supply in the form of a flexible bag 7.

Figure 2:
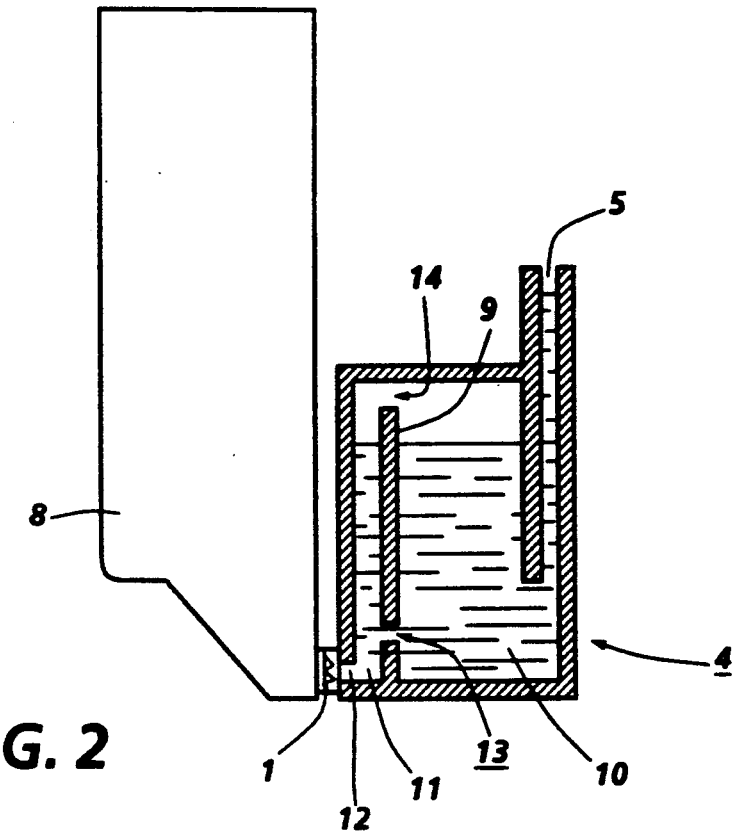
FIG. 2 is a schematic diagram, partly in cross-section, of a printhead assembly of a thermal ink jet printer.

FIG. 2 shows a schematic diagram of the printhead assembly, comprising a printhead 1 and its associated reservoir 4 and heat sink 8, in greater detail. In this assembly, the orientation of the printhead and reservoir shows the printhead from its back edge so that the orifices, shown in dashed line, eject droplets into the surface of the sheet. Refer to U.S. Pat. No. 4,774,530 for more a detailed explanation of a printhead similar to one in the printhead assembly of this invention. The reservoir 4 of FIG. 2 has an ink inlet 5 to which the supply line 6 from the ink bag 7 would be connected. Mounted on the other side of the printhead 1 is a heat sink 8 which carries heat generated by the channel resistors away from the printhead. Both the reservoir 4 and the heat sink 8 are mounted on the carriage 2 for movement with the printhead 1.

Internally, the reservoir 4 of FIG. 2 is divided by a partition wall 9 into two chambers 10,11. Chamber 10, which is the larger of the two, is in direct communication with the ink inlet 5, and chamber 11 is in direct communication at 12 with the ink channels of the printhead either through a preferable common outlet or through a plurality of respective outlets. Openings 13 in the partition wall 9 and a gap 14 above the wall provide communication between the chambers 10 and 11. The openings 13 (only one of which is visible) are located towards the bottom of the wall 9 (i.e. in the lower part of the reservoir 4) and offer a combined resistance to ink flow greater than that of the gap 14 at the top of the wall. Typically, there are four openings 13, each having a diameter of 1 mm, while the width of the gap 14(which extends the length of the wall 9) is not less than 2 mm.

The arrangement functions as follows.

When a printing operation is in progress, the reservoir 4 contains some ink, as shown in FIG. 2. As ink is expelled from the channel orifices of the printhead 1 it is replaced by ink drawn by capillary action into the channels from the chamber 11 of the reservoir 4. Ink also flows into the chamber 11 from the chamber 10 through the opening 13 in the partition wall 9 and replacement ink is drawn into the reservoir through inlet 5 from the ink bag 7. Any air that may separate out of the ink in the reservoir 4 collects at the top of the reservoir, above the ink, so that the amount of ink within the reservoir decreases over a period of time.

From time to time, it is necessary to prime the printhead assembly of FIG. 2 to ensure that the reservoir 4 and the ink channels in the printhead 1 contain sufficient ink. Priming is, for example, carried out if the amount of ink within the reservoir 4 falls below a certain level or if the ink bag 7 becomes exhausted and is replaced by another, and it may also be carried out as a matter of course when the printer is brought back into operation after a period of idleness. After priming, the reservoir 4 preferably contains as much ink as possible so that the surface level of the ink is well above the ink outlet(s) 12 from the reservoir to the printhead 1. In that way, it can be ensured that air will not enter the printhead from the reservoir during printing despite any movement of the ink that may occur due to movement of the carriage 2. In addition, because air tends to separate out from the ink in the reservoir, the presence of as large a volume of ink as possible allows the greatest amount of air to separate out before a failure in the ink supply occurs.

The construction of the reservoir 4 shown in the drawing enables the printhead assembly to be primed either by delivering ink to the reservoir under pressure or by applying suction to the reservoir via the ink ejecting orifices in the printhead. For the present, it will be assumed that priming is carried out by applying pressure to the ink bag 7 to force ink comparatively rapidly into the reservoir 4 through the inlet 5, with the result that ink/air is displaced from the reservoir through the outlet(s) 12 and the printhead nozzles. Because of the substantially lower flow resistance offered by the gap 14 at the top of the partition wall 9, flow within the reservoir will take place preferentially through the opening 14 with the result that the air at the top of the chamber 10 will first be displaced into the the chamber 11. As the chamber 10 fills up with ink, the air displaced into the chamber 11 will be forced out of the reservoir 4 and then out of the printhead 1 through the ink ejecting orifices. Thereafter, ink will spill from the chamber 10 over the top of the wall 9 so that the chamber 11 will then also fill with ink and the assembly will be primed.

When the printhead assembly has been primed and printing has commenced, the assembly is as shown in the drawing and already described. Any air which is drawn into the reservoir 4 with the ink can separate out in the reservoir and will occupy the space above the ink as shown and as already described. When too much air collects in the reservoir, the assembly is primed again.

The ink supply system for the printhead assembly shown in the drawing is comparatively simple in that it requires only one external line to be connected to the reservoir 4, namely the ink supply line 6 from the ink bag 7. No vent line is required for the removal of air from the reservoir during priming because, as described, the internal construction of the reservoir ensures the removal of air through the printhead when priming is being carried out. Compared with an arrangement that has both an ink supply line and a vent line connecting the on-board reservoir to the remote ink supply, that shown in the drawing offers the advantages of reduced cost, a simplified layout through the use of one external line only, and fewer forces acting on the printhead carriage 2.

If priming is carried out by applying suction to the printhead orifices rather than by applying pressue to the ink bag 7, the flow within the reservoir 4 will still be as described above i.e. it will still take place preferentially through the gap 14 with the result that the air within the reservoir will be drawn out through the chamber 11 and the printhead. Suction can be applied to the printhead orifices at a maintenance/capping head provided in the printer and usually located to one side of the recording medium 3, the printhead 1 being parked at the maintenance station when the printer is idle or when maintenance is required.

To ensure that priming occurs as described above, i.e. that the chamber 10 within the reservoir 4 fills with ink before ink flows into the chamber 11, it is important that ink should flow into the reservoir corparatively rapidly during priming. If ink flows into the reservoir too slowly, there will be leakage of ink through the lower openings 13 before the chamber 10 has been filled. For example, the ink flow rate into the reservoir during priming may be 15 cc/min compared with a flow rate during printing of 6.5 cc/min.

In the arrangement shown in FIG. 2, the required difference in the flow resistances of the openings 13 and the gap 14 is achieved simply by a difference in size. It could, however, be achieved by replacing the openings 13 by a valve which would allow ink to flow through during a printing operation but would close during priming.

It will be appreciated that, although the above description refers to the use of four openings 13 in the partition wall 9, any number of openings could be used. Likewise, the single gap 14 at the top of the wall 9 could be replaced by a plurality of openings.

Figure 3:
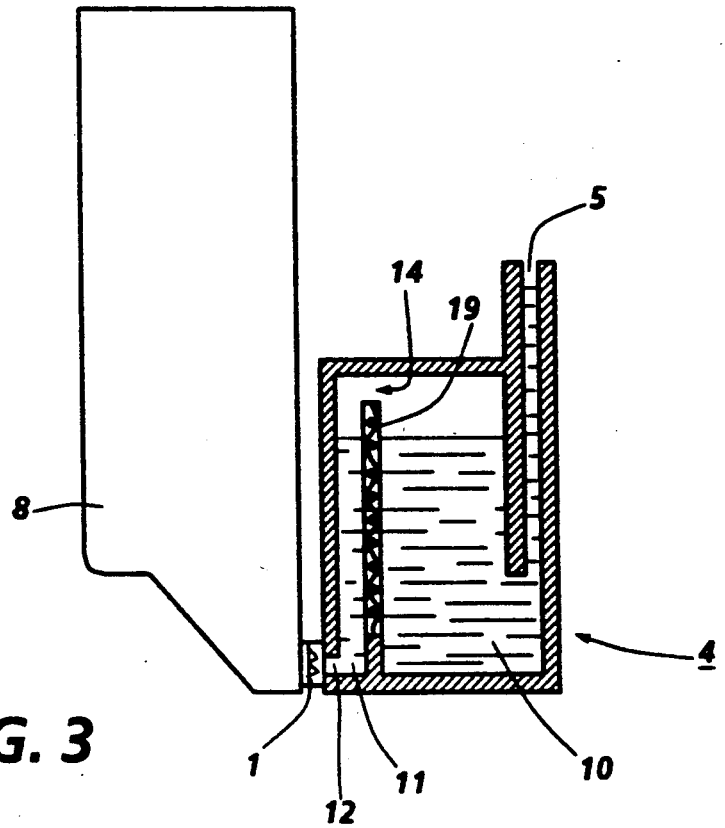
FIGS. 3 and 4 are similar to FIG. 2 but illustrate modifications to the assembly.

FIG. 3 illustrates a modification of the assembly shown in FIG. 2, in which the partition wall 9 is replaced by a screen mesh 19. In this case, the opening(s) 13 in the partition are not required and are omitted. The screen mesh 19 may, for example, be a "20μ (200×900 mesh) Stainless Cloth-UFMC Wire-Type 316L" available from the Unique Wire Weaving Co. Inc. When the assembly shown in FIG. 3 is being primed, ink flows comparatively rapidly into the reservoir and fills the chamber 10 as described for FIG. 2. When the ink reaches the top of the mesh partition 19, it will spill over into the chamber 11 and wet the other side of the screen, whereupon ink flows through the screen as well as through the gap 14 to fill the chamber 11. During a printing operation, ink flow through the reservoir is through the screen 19.

Figure 4:
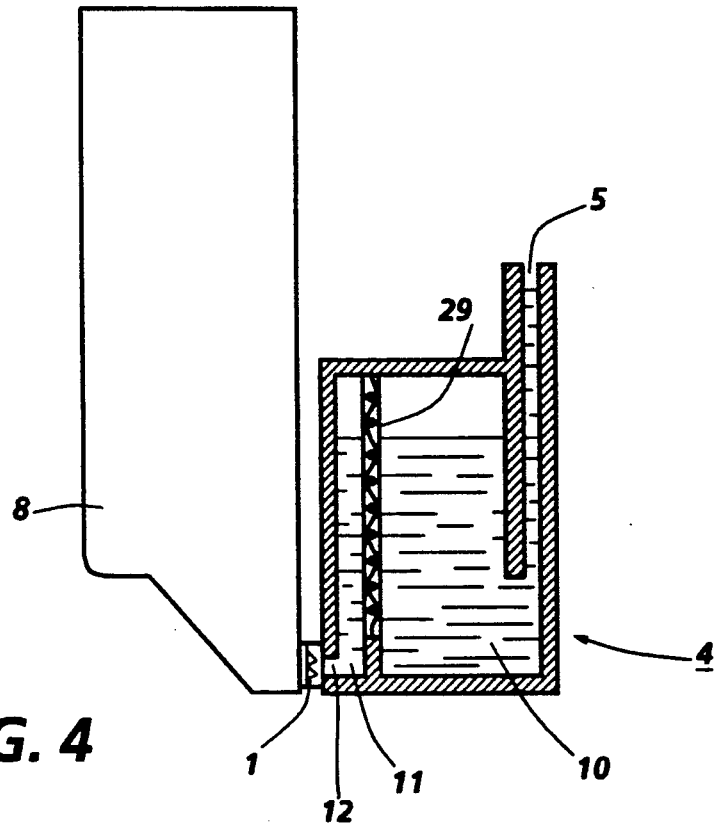

Yet another modification is illustrated in FIG. 4. In this case, the partition 29 within the reservoir is again in the form of a screen mesh but the gap at the top of the partition is omitted and the screen extends completely to the top of the reservoir 4. When the printhead assembly shown in FIG. 4 is being primed, the openings in the screen 29 initially resist the flow of ink but permit the flow of air so that ink flows into, and fills, the chamber 10 on one side of the screen while air displaced by the incoming ink flows through the screen and out of the printhead assembly through the printhead orifices. When the chamber 10 is full, the increasing pressure of the ink eventually overcomes the resistance of the screen openings and ink flows through the screen 29 to fill the chamber 11 also. Typically, ink is supplied to the reservoir at a pressure of 40" $H_2O$ during priming. During a printing operation, ink flow through the reservoir is through the screen, as in FIG. 3.

The arrangement shown in FIG. 4 has the advantage that all ink reaching the printhead passes through, and will be filtered by, the screen 29.

In each of the arrangements shown in FIGS. 2 to 4, the dimensions of the smaller chamber 11 in the reservoir 4 should be sufficiently large to prevent the flow of ink by capillary action. To that end, the partition 9, 19, 29 should be at least spaced 2 mm away from the wall of the reservoir containing outlet(s) 12.

Although the printhead assemblies described above are for a thermal ink jet printer, similar arrangements could be employed for the printhead assemblies of other forms of drop-on-demand ink jet printer. The arrangements could be employed in printers having a plurality of printheads which need not be mounted on a movable carriage but could, for example, form a fixed array in a so-called "pagewidth printer". In that case, the printhead are accurately positioned side-by-side to form a pagewidth array which remains stationary while the recording medium is moved in a direction perpendicular to the length of the array.

The general method described above for priming a printhead assembly by providing a partition within the printhead reservoir could be utilized for filling any fluid chamber when the only available air vent is an outlet in the lower region of the chamber, similar to the reservoir outlet 12 in FIGS. 2 to 4. The provision of a partition within the fluid chamber, as described above, would enable the chamber to be filled with fluid to a level above the only available vent, in the same manner as the reservoir 4.

I claim:

1. A printhead assembly for an ink jet printer, comprising a printhead and an ink reservoir having an upper and a lower region, an inlet for receiving ink, and an outlet located in the lower region thereof, the printhead having at least one ink channel that communicates with the reservoir outlet, an ink ejecting orifice at one end of the channel and means operable to cause droplets of ink to be expelled from the orifice for depositing on a recording medium, the reservoir having a partition means located within the reservoir which defines a chamber on one side of the partition means that communicates with said inlet and a chamber on the other side of the partition means that communicates with said outlet, the partition means having means for providing communication between the chambers, including at least one opening therethrough in the reservoir upper region, so that the chamber with the inlet fills first and because of the absence of a vent in the reservoir, air is vented from the printhead assembly through the ink ejecting orifice when said printhead assembly is primed.

2. An assembly as claimed in claim 1, wherein the means for providing communication between the chambers by said partition means comprises at least one opening through the partition means in the lower region of the reservoir, and the at least one opening through the partition means in the upper region of the reservoir; and wherein the total resistance to ink flow presented by the opening through the partition means in the upper region of the reservoir is less than the total resistance to ink flow presented by the opening in the partition means in the lower region of the reservoir, so that the flow within the reservoir from the inlet to the outlet is greater through the upper region of the reservoir during priming assuring removal of air in said upper region of the reservoir through the printhead orifice.

3. An assembly as claimed in claim 2, in which the opening in the upper region of the reservoir comprises a single opening at the top of the partition means extending lengthwise thereof.

4. An assembly as claimed in claim 2, in which the said at least one opening in the lower region of the reservoir includes valve means operable to permit ink flow therethrough during printing and to prevent ink flow therethrough when the assembly is being primed.

5. An assembly as claimed in claim 1, wherein the partition means comprises a screen mesh; and wherein the at least one opening through said screen mesh is at the top of the screen mesh extending lengthwise thereof.

6. An assembly as claimed in claim 1, in which the assembly is primed by applying suction to the printhead orifice to draw ink into the reservoir through the said inlet.

7. An assembly as claimed in claim 1, in which the assembly is primed by supplying ink under pressure to the reservoir through the said inlet.

8. An ink jet printer comprising at least one printhead assembly and an ink source, the printhead assembly comprising a printhead and an ink reservoir which is connected to said ink source, the printhead having at least one ink channel that communicates with the reservoir, an ink ejecting orifice at one end of the channel and means operable to cause droplets of ink to be expelled from the orifice for depositing on a recording medium, the reservoir having an upper and a lower region, an inlet for connection to the ink source, an outlet in the reservoir lower region for placing the reservoir in communication with the ink channel, and a partition means located within the reservoir which forms a chamber on one side of the partition means with said inlet therein and a chamber on the other side of the partition means that communicates with said outlet, the partition means having at least one opening through the lower region of the reservoir and at least one opening through the upper region of the reservoir, the total resistance to ink flow presented by the opening in the upper region of the reservoir being less than the total resistance to ink flow presented by the opening in the lower region of the reservoir, so that flow within the reservoir from the inlet to the outlet is greater through the upper region of the reservoir during priming, thereby ensuring removal of air in said reservoir and said printhead channel through the printhead orifice.

9. A printer as claimed in claim 8, in which the printhead assembly is mounted on a scanning carriage for reciprocal movement across the recording medium.

10. A printer as claimed in claim 8, wherein the partition means comprises a screen mesh.

11. A printer as claimed in claim 8, in which the assembly is primed by applying suction to the printhead orifice to draw ink from the said source into the reservoir through the said inlet.

12. A printer as claimed in claim 8, in which the assembly is primed by supplying ink from the said source under pressure to the reservoir through the said inlet.

13. A method of priming a printhead assembly for an ink jet printer, the printhead assembly having a printhead and an ink reservoir with upper and lower regions, the printhead having at least one ink channel in communication with the reservoir, the channel having an ink ejecting orifice at one end and means operable to cause droplets of ink to be expelled from the orifice for deposition on a recording medium, the method comprising the steps of:

supplying ink to the reservoir from an ink supply under a pressure;

partitioning the reservoir without a vent into two chambers with a partition, one chamber being adapted to receive the ink and the other chamber being adapted to communicate with the printhead channel at the lower region of the reservoir;

providing means for communication between the chambers through the partition in both the upper and lower regions of the reservoir, the means for communication provided through the partition in the upper region of the reservoir having less ink flow resistance than the means for communication provided through the partition in the lower region of the reservoir, so that the chamber receiving the pressurized ink is substantially filled first before the other chamber is filled, thereby causing any air in the reservoir and the printhead channel to be vented through the printhead orifice since there are no other vents in the printhead assembly.

14. The method of priming a printhead assembly as claimed in claim 13, wherein the means for communication are openings in said partition and the openings in the upper regions are larger than the openings in the lower regions.

15. The method of priming a printhead assembly as claimed in claim 13, wherein the partition is a screen mesh.

16. The method of priming a printhead assembly as claimed in claim 15, wherein the means for providing less ink flow resistance through said screen in the upper region is provided by an elongated opening therein.

* * * * *